US005209645A

United States Patent [19]

Kojima et al.

[11] Patent Number: 5,209,645

[45] Date of Patent: * May 11, 1993

[54] CERAMICS-COATED HEAT RESISTING ALLOY MEMBER

[75] Inventors: Yoshitaka Kojima, Hitachi; Akira Mebata, Kitaibaraki; Noriyuki Ohnaka, Katsuta; Akihiko Chiba, Morioka; Ryoichiro Ohoshima, Hitachi; Norio Watanabe, Tokyo; Yukiyoshi Hara, Ageo, all of Japan

[73] Assignees: Hitachi, Ltd.; The Tokyo Electric Power Company, Ltd., both of Tokyo, Japan

[ * ] Notice: The portion of the term of this patent subsequent to Oct. 30, 2007 has been disclaimed.

[21] Appl. No.: 538,759

[22] Filed: Jun. 15, 1990

[30] Foreign Application Priority Data

May 6, 1988 [JP] Japan ..... 63-109025
Jun. 16, 1989 [JP] Japan ..... 1-154044

[51] Int. Cl.[5] ..... B63H 1/26

[52] U.S. Cl. ..... 416/241 B; 416/224; 428/622

[58] Field of Search ..... 416/241 B, 241 R, 224; 428/622, 632

[56] References Cited

U.S. PATENT DOCUMENTS

| | | | |
|---|---|---|---|
| 2,115,733 | 5/1938 | Krivobok | 416/241 X |
| 3,129,069 | 4/1964 | Hanink et al. | 416/241 R X |
| 3,293,030 | 12/1966 | Child et al. | 416/224 |
| 3,394,918 | 7/1968 | Wiseman | 416/241 |
| 3,801,353 | 4/1974 | Brill-Edwards | 416/241 X |
| 3,951,612 | 4/1976 | Gates et al. | 416/241 B X |
| 4,169,726 | 10/1979 | Fairbanks | 416/241 R X |
| 4,503,130 | 3/1985 | Bosshart et al. | 428/632 |
| 4,745,033 | 5/1988 | Timmons | 416/241 R X |
| 4,774,150 | 9/1988 | Anano et al. | 416/241 B X |
| 4,842,953 | 6/1989 | Perkins et al. | 416/241 R X |
| 4,869,645 | 9/1989 | Verpoort | 416/241 R |
| 4,884,820 | 12/1989 | Jackson et al. | 416/241 R X |
| 4,904,542 | 2/1990 | Mroczkowski | 416/241 B X |
| 4,916,022 | 4/1990 | Solfest et al. | 416/241 B X |
| 4,927,714 | 5/1990 | Priceman | 416/241 B X |
| 4,966,820 | 10/1990 | Kojima et al. | 428/622 |

FOREIGN PATENT DOCUMENTS

| | | | |
|---|---|---|---|
| 0048103 | 5/1978 | Japan | 416/241 R |
| 0096104 | 6/1983 | Japan | 416/241 R |
| 0000694 | 1/1987 | Japan | 416/241 R |
| 0113802 | 5/1987 | Japan | 416/241 R |

*Primary Examiner*—Edward K. Look
*Assistant Examiner*—Todd Mattingly
*Attorney, Agent, or Firm*—Antonelli, Terry, Stout & Kraus

[57] ABSTRACT

A gas turbine bucket and a gas turbine nozzle applied with a ceramic coating comprises a base material of the bucket and the nozzle made of a heat resisting alloy; a plurality of coating layers for the front portion consisting of, a mixture layer which comprises a ceramic material and metal and which is formed on the base material, an alloy layer which comprises an alloy material exhibiting excellent resistance to high temperature oxidation and corrosion and which is formed on the mixture layer, and a ceramic layer which comprises ceramic material and formed on the alloy layer. Such ceramic coating has a satisfactory thermal barrier effect on the base material of the gas turbine bucket and nozzle.

35 Claims, 8 Drawing Sheets

CERAMICS-COATED HEAT RESISTING ALLOY MEMBER

BACKGROUND OF THE INVENTION

1. Field of the Invention

The present invention relates to a heat resistant alloy member, and in particular, to a gas turbine bucket and a gas turbine nozzle which are used at high temperatures or in corrosive environments at high temperatures.

2. Description of the Prior Art

Techniques for improving the heat resisting property of structural members of gas turbines operated by high temperature gas have been investigated with a view for improving the thermal efficiency of gas turbine power stations. The establishment of the above-mentioned techniques is necessary for coal gasification power stations having higher cost of fuel in order to enhance its economically competitive ability against the other kind of power stations. There is therefore a demand for improved heat resisting alloy members in order to cope with the intention to increase the gas temperatures for gas turbine power stations. A principal method of providing members with heat resistance at higher temperatures is to develop new materials for forming such members. Among various types of metal materials, Ni or Co-based alloys have heat resistant temperatures of about 850° C. On the other hand, a ceramic material has a sufficient heat resisting property for high temperatures but involve certain problems with respect to their toughness and so on, particularly when it is used in buckets which serve as high-speed rotors. Thus another method of achieving the technique for improving a heat resisting property is to prevent any increase taking place in the temperature of the relevant members. An example of this method is the combination of cooling members and coating members with a ceramic material having a low degree of thermal conductivity. Such a coating is called a thermal barrier coating. A bucket and a nozzle for a gas turbine are respectively provided with thermal barrier coating. A thermal barrier coating comprises a base metal composed of a heat resisting alloy and a coating of a ceramic material having physical properties which are different in numerical value from those of the base metal. An important technical problem of the thermal barrier coating is thus to reduce the thermal strain and thermal stress produced owing to the difference in the numerical values of the physical properties between the base metal and the ceramic coating. In particular, damage such as separation or the like may occur in the ceramic coating layer owing to the thermal stress based on a cyclic heating from starting to stopping of a gas turbine. A known method of reducing thermal stress is the method in which an intermediary layer is provided which serves to reduce the difference in thermal expansion coefficient between the ceramic coating layer and the base metal composed of a heat resisting alloy. Such an intermediary layer is disclosed in, for example, Japanese Patent Laid-Open No. 211362/1987. The intermediary layer is generally a mixture layer comprising a ceramic material and a metal. Although the thermal expansion coefficient of such a mixture layer depends upon the mixing ratio used, it is generally considered that the mixture layer should have a thermal expansion coefficient of a value midway between those of the ceramic material and the metal. When this sort of mixture layer is interposed between a ceramic layer and a base metal, a function of reducing thermal stress can, as a matter of course, be expected.

On the other hand, since the ceramic coating layer used in the thermal barrier coating is mainly formed by spray coating, it is a porous substance. This porous ceramic coating layer is capable of reducing thermal stress by itself by virtue of its porous structure. However, since the ceramic coating layer may be used in corrosive environments at high temperatures, high temperature oxidation or high temperature corrosion takes place in the mixture layer provided below the ceramic coating layer through the ceramic coating layer which consists of a porous substance. The inventors have thus conducted oxidation tests on mixture coating layers comprising ceramic materials and metals. Each of the test pieces employed was made by forming a mixture coating layer on a surface of a base metal and then removing the base metal to form a sample comprising a mixture. Each of the thus-formed test pieces was then subjected to an oxidation test under heating at 1000° C. for 1000 hours in the atmosphere. As a result, internal oxidation proceeded to a significant extent in each of the test pieces comprising mixtures in the oxidation tests. It is though that such internal oxidation proceeds through cavities present at grain boundaries in the coating layers which comprises the mixture of ceramic powder and metal powder and which is simply formed by laminating the two types of powder by spray coating. Such internal oxidation in a mixture layer proceeded to a significant extent in a ceramic-coated test piece comprising a ceramic coating layer, a mixture layer and a base metal. The ceramic layer in this ceramic-coated test piece became separated after a high-temperature oxidation test at 1000° C. for 1000 hours. Thus the mixture layer provided for the purpose of reducing thermal stress cannot achieve the intended purpose. It is thought that the separation of the ceramic layer is caused by the thermal stress newly produced in the mixture layer owing to the internal oxidation in the mixture layer itself and by a reduction in the adhesion between the ceramic coating layer and the mixture layer owing to the oxidation at the boundary therebetween. Such a problem causes a reduction in the reliability of the thermal barrier coating. On the other hand, a thermal barrier effect required for the thermal barrier coating is increasingly improved as the working temperature of a gas turbine is raised. In other words, it is necessary to increase the thickness of the ceramic coating layer for the purpose of improving the thermal barrier effect. In this case, the thermal stress produced by a repeated heat load or the like is of course increased. It is therefore necessary to improve the durability of the ceramic coating by reducing the thermal stress produced in the ceramic coating layer owing to a repeated heat load or the like.

Furthermore, in a case where the bucket and the nozzle of a gas turbine are respectively applied with a thermal barrier coating having poor reliability, the separation of a ceramic layer will cause the heat insulating characteristics to be deteriorated and the temperature of the blade to be raised. As a result, the reliability of the bucket and the nozzle may be excessively deteriorated. In the case of the bucket and the nozzle of a gas turbine, the conduction of heat from the combustion gas to the portion in the vicinity of the leading edge of the blade is relatively large, causing the temperature of the above-described portion to be particularly raised. Therefore, the thermal barrier coating applied to the portion in the vicinity of the leading edge of the blade must have heat insulating characteristics. On the other hand, heat conductance from the combustion gas becomes smaller on the suction surface and the pressure surface of the blade. Therefore, the temperature of these portions is maintained at a low degree. Therefore, the bucket and the nozzle must be applied with the thermal barrier coating exhibiting both excellent heat insulating characteristics and durability. On the other hand, the suction surface and the pressure surface of the blade define the gap between the neighboring blades and the above-described gap serves as a passage through which the combustion gas flows. Therefore, this gap serves as a factor to influence the gas turbine performance. However, the portion in the vicinity of the leading edge of the blade does not serve as a factor in defining the passage through which the combustion gas flows.

Therefore, the portion in the vicinity of the leading edge of the blade must be applied with a thermal barrier coating having excellent high temperature resistance and heat insulating characteristics. On the other hand, the suction surface and the pressure surface of the blade, on which only a reduced thermal load acts, must be applied with, as an alternative to a coating exhibiting an excellent heat insulating characteristics, a coating having a characteristic enabling the change of the flow passage, through which the combustion gas passes, to be reduced. The conventional thermal barrier coating including an intermediary layer has been used for the purpose of relaxing the thermal stress generated between a ceramic coat and the base material. However, the heat and oxidation resistance of the intermediary layer has been insufficient and the thermal stress relaxing effect of the intermediary layer has not been satisfactory at high temperatures. Furthermore, the intermediary layer does not exhibit satisfactory resistance to high temperature corrosion.

An object of the present invention is to provide a bucket and a nozzle for a gas turbine to which a ceramic coating is applied, the ceramic coating enabling the thermal stress relaxing effect, which is the original object of the intermediary layer which is the mixture of ceramic material and metal, to be exhibited in high temperature oxidation and corrosion environments. Furthermore, the ceramic coating enables an easy determination of the gap between the neighboring buckets or the nozzles to be made at the time of manufacturing process and stable maintaining of the interval for a long time, causing the flow passage through which the combustion gas passes to be maintained for a long time. Consequently, the performance of the gas turbine can be satisfactorily and stably maintained for a long time.

SUMMARY OF THE INVENTION

It is an object of the present invention to provide a gas turbine bucket and a gas turbine nozzle applied with a ceramic coating which is formed in the vicinity of the leading edge of the blade or the bucket and having an alloy layer which comprises an alloy material exhibiting excellent resistance to high temperature oxidation and resistance to high temperature corrosion and which is formed between a ceramic layer and a mixture layer comprising a ceramic material and a alloy metal.

The present invention provides a gas turbine bucket and a gas turbine nozzle (a bucket and a nozzle are referred to as "blade" hereinafter) applied with a ceramic coating comprising: a base material of the blade made of a heat resisting alloy the main component of which is selected from at least one of nickel, cobalt and iron; a plurality of coating layers for the front portion of the blade which is applied to a region extending from the leading edge of the blade to the suction surface and the pressure surface of the blade in substantially a quarter length of the overall length of the profile of the blade; the coating layers for the front portion consisting of: a mixture layer which comprises a ceramic material and metal and which is formed on the base material; an alloy layer which comprises an alloy material which is superior to the base material with respect to its resistance to high temperature oxidation and resistance to high temperature corrosion and which is formed on the mixture layer; and a ceramic layer which comprises a ceramic material and which is formed on the alloy layer.

In the above-described gas turbine bucket and gas turbine nozzle, the thickness of the ceramic layer is 0.05 to 1.0 mm, that of the alloy layer is 0.03 to 0.5 mm and that of the mixture layer is 0.03 to 0.5 mm.

In the above-described gas turbine bucket and gas turbine nozzle, the alloy layer comprises at least one of cobalt and nickel as a main component, chromium and aluminum and at least one of hafnium, tantalum, yttrium, silicon and zirconium.

The present invention further provides a gas turbine bucket and nozzle applied with a ceramic coating comprising a base material of the blade made of a heat resisting alloy the main component of which is selected from at least one of nickel, cobalt and iron; a plurality of coating layers for the front portion of the blade which is applied to a region extending from the leading edge of the blade to the suction surface and the pressure surface of the blade in substantially a quarter length of the overall length of the profile of the blade; the plurality of coating layers for the front portion consisting of: a first alloy layer which comprises an alloy material superior to the base material with respect to its resistance to high temperature oxidation and resistance to high temperature corrosion and which is formed on of the base material; a mixture layer which comprises a ceramic material and a metal and which is formed on the first alloy layer; a second alloy layer which comprises an alloy material superior to the base material with respect to its resistance to high temperature oxidation and resistance to high temperature corrosion and which is formed on the mixture layer; and a ceramic layer which comprises a ceramic material and which is formed on the second alloy layer.

Further the present invention provides a gas turbine bucket and nozzle applied with a ceramic coating comprising a base material of the blade made of a heat resisting alloy the main component of which is selected from at least one of nickel cobalt and iron; a plurality of coating layers for the front portion which is applied to a region extending from the leading edge of the blade to the suction surface and the pressure surface of the blade in substantially a quarter length of the overall length of the profile of the blade; and a plurality of coating layers for the rear portion which is applied to the surface of the blade except for the region, the plurality of coating layers for the front portion consisting of: a first alloy layer which comprises an alloy material superior to the base material with respect to its resistance to high temperature oxidation and resistance to high temperature corrosion and which is formed on the surface of the base material; a mixture layer which comprises a ceramic material and metal and which is formed on the first alloy layer; a second alloy layer which comprises an alloy material superior to the base material with respect to its resistance to high temperature oxidation and resistance to high temperature corrosion and which is formed on the mixture layer; and a first ceramic layer which comprises a ceramic material and which is formed on the second alloy layer; and the plurality of coating layers for the rear portion consisting of: a third alloy layer which comprises an alloy material superior to the base material with respect to its resistance to high temperature oxidation and resistance to high temperature corrosion and which is formed on the surface of the base material; and a second ceramic layer which comprises a ceramic material and which is formed on the third alloy layer, wherein the thickness of the coating layers for the rear portion is smaller than that for the front portion and successively formed. End portions of the mixture layer of the coating layer for the front portion are sealed by the third alloy layer of the coating layer for the rear portion.

In the above-described gas turbine bucket and nozzle, the thickness of each of the ceramic layer is 0.05 to 1.0 mm, the thickness of each of the alloy layers is 0.03 to 0.5 mm and the thickness of the mixture layer is 0.03 to 0.5 mm.

The alloy layers used in the above-described gas turbine bucket and nozzle comprise at least one of cobalt and nickel as a main component, chromium and aluminum and at least one of hafnium; tantalum, yttrium, silicon and zirconium.

According to the present invention, the oxidation and corrosion of the mixture layer of ceramic material and metal of the leading edge of the blade, which is subjected to the severest conditions, at high temperatures can be prevented by an alloy layer formed between the ceramic layer and the mixture layer. As a result, the mixture layer becomes stable at high temperature oxidation environments and high temperature corrosive environments. Therefore, original effect of the mixture layer for relaxing the thermal stress generated between the ceramic layer and the base material can be sufficiently exhibited.

The ceramic coating of which the thermal stress relaxing effect is stable in high temperature oxidation environments and high temperature corrosive environments is capable of displaying an improved durability. Furthermore, even if the thickness of the ceramic layer is enlarged for the purpose of improving the heat insulating effect, the durability cannot be deteriorated excessively. As a result, the temperature of the blade material for forming the leading edge of the blade to which the largest amount of heat is supplied from the combustion gas can be stably reduced for a long time.

Furthermore, since the mixture layer displays the smaller heat conductance than that of an alloy layer, it does not contribute in terms of the heat conductance. However, the mixture layer is able to serve as resistance when heat insulating characteristics are obtained.

The alloy layer has the function of protecting the mixture layer from oxidation and corrosion which proceed at high temperature through the porous ceramic coating layer. That is, since the mixture layer comprises a mixture of ceramic grains and metal grains and has a thermal expansion coefficient of a value midway between those of the ceramic material and the metal, it has the function of reducing the thermal strain produced between the ceramic coating layer and the heat resisting alloy base metal and the thermal stress produced owing to this strain. Since the mixture layer does not possess a sufficient degree of resistance to high temperature oxidation and or high temperature corrosion because cavities are present at the grain boundaries, however, the outside portion of the mixture layer is protected by the alloy layer provided between the mixture layer and the ceramic coating layer, whereby high temperature oxidation and high temperature corrosion are prevented. The mixture layer consequently remains stable even under conditions of high temperature oxidation and high temperature corrosion and is thus able to satisfactorily exhibit its primary function of reducing the thermal stress between the ceramic coating layer and the heat resisting alloy base metal.

As described above, since the thermal barrier coating exhibiting excellent high temperature durability and heat resistance property is applied to the portion in the vicinity of the leading edge of each of the bucket and the nozzle for a gas turbine, the reliability of the leading edge of the blade which is subjected to the severest thermal and corrosive environments at high temperatures can be improved. Furthermore, the thickness of the coating layer for portions except for the leading edge of the blade can be reduced. Therefore, a necessity of adjusting the gap between the neighboring blades can be eliminated. Therefore, an excellent advantage can be obtained in terms of the manufacturing yield and another advantage can be obtained in that the performance can be stably maintained for a long time.

An effect of eliminating the thick ceramic coating, which is applied to the leading edges of the bucket and the nozzle for a gas turbine, from the suction surface and the pressure surface of the same will be described. The performance of a gas turbine is defined by the gap between the suction surface and the pressure surface of the neighboring blades. The above-described gap is a critical factor for designing a gas turbine and the dimensions of the blade must be determined in consideration of the thickness of the coating layer in the case where a thick ceramic coating is applied. The thickness of the base material for the suction surface and the pressure surface of the blade is several mms since the structure of a high performance blade is arranged in such a manner that the inside portion of the blade is cooled by air. Therefore, it is very difficult to adjust the above-described gap by grinding the surface of the base material for the blade since the strength of the base must have desired strength. Therefore, the gap must be arranged when the blade is precisely cast. In this case, the casting mold must be modified for applying the ceramic coating to the blade which has not as yet been applied with a coating. Therefore, the overall manufacturing cost can be raised. Furthermore, in the case where the blade the gap of which has been adjusted is used, the gap can be enlarged when the coating has been worn or damaged, causing the performance of the gas turbine to be deteriorated. According to the present invention, the necessity of adjusting the gap can be eliminated since the thickness of the coating layer applied to the suction surface and the pressure surface is reduced. Therefore, the performance of the gas turbine can be stably maintained for a long time.

The object, advantages and novel characteristics of the present invention are described in detail below with reference to the attached drawings.

DETAILED DESCRIPTION OF THE PREFERRED EMBODIMENTS

Figure 11:
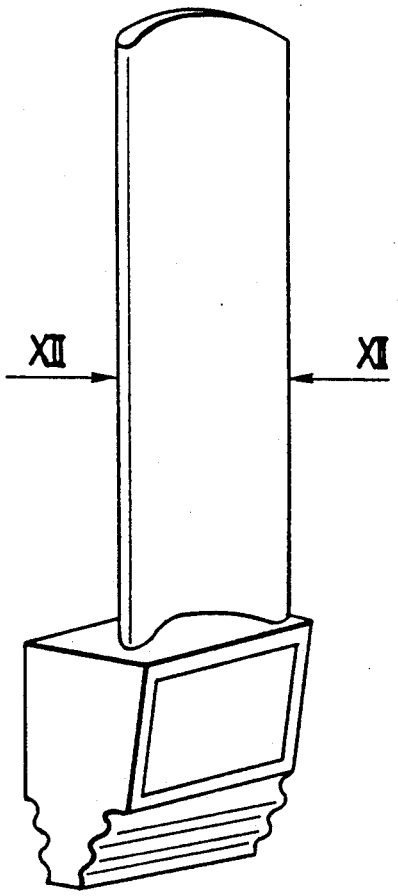
FIG. 11 PRIOR ART
FIG. 11 is a perspective view of a conventional gas turbine bucket.
Figure 12:
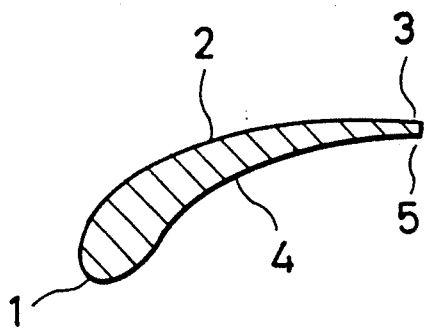
FIG. 12 PRIOR ART
FIG. 12 is a schematically cross sectional view taken along line XII—XII of the bucket of FIG. 11.
Figure 14:
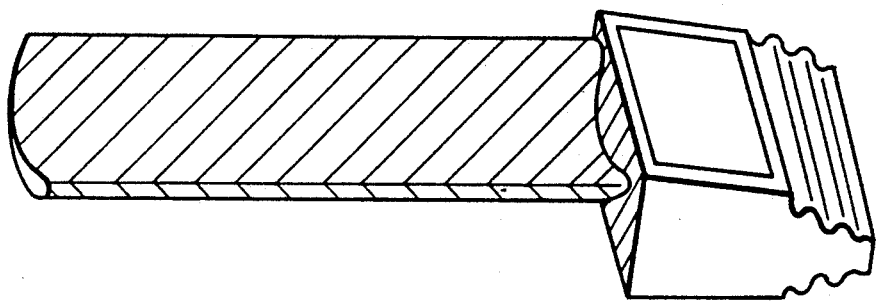
FIG. 14 PRIOR ART
FIG. 14 is a perspective view of a conventional gas turbine bucket coated with a thermal barrier coating layer.
Figure 13:
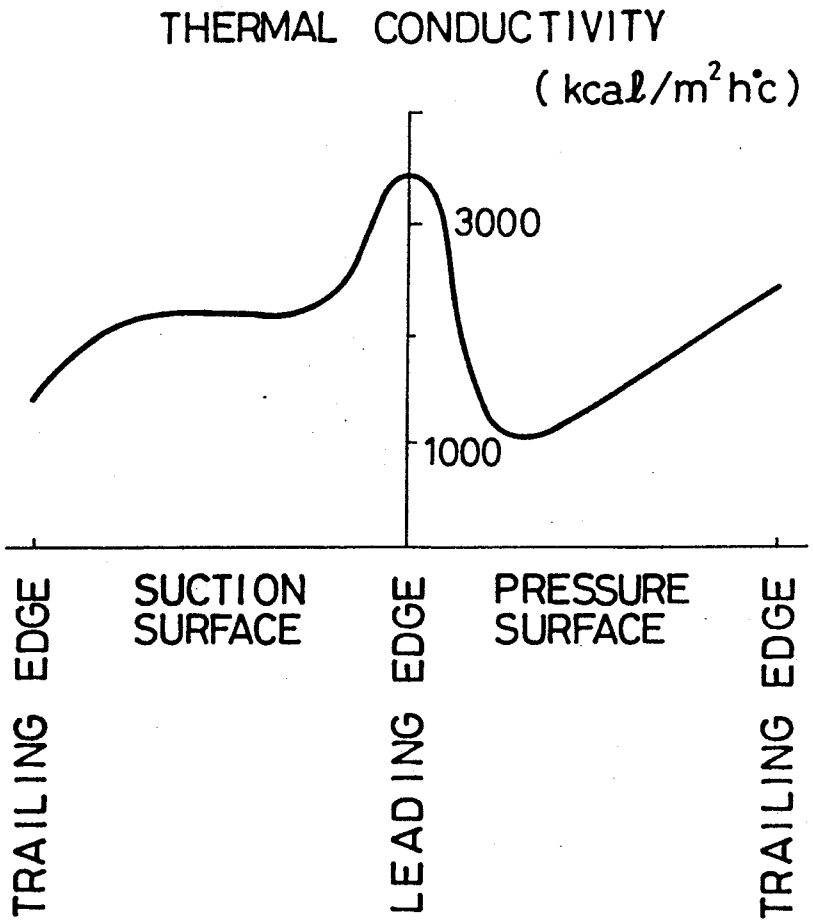
FIG. 13 is a graph illustrating heat distribution of a combustion gas on the surface of the gas turbine bucket.

FIG. 11 and FIG. 12 are respectively a perspective view and a cross sectional view of a known gas turbine bucket. In FIG. 12, the bucket profile comprises a leading edge 1, a suction surface 2, a trailing edge of the suction surface 3, a pressure surface 4 and a trailing edge of the pressure surface 5, as shown. FIG. 13 shows ratios of heat transmission from a combustion gas to the bucket at each of the above portions. According to FIG. 13, it is clear that the heat transmission ratio at a leading edge portion is great, that is, a great deal of heat is concentrated upon that portion. FIG. 14 shows a known thermal barrier coated bucket. In FIG. 14, portions of the bucket subjected to the combustion gas, that is, hatched portions as shown are provided with the thermal barrier coating.

Figure 5:
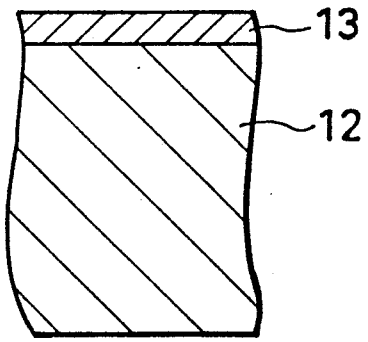
FIG. 4 and FIG. 5 are schematically enlarged sectional views of a heat resisting-coated trailing edge portion of the bucket of the present invention.
Figure 4:
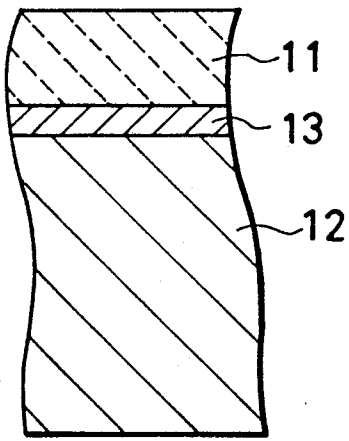
Figure 3:
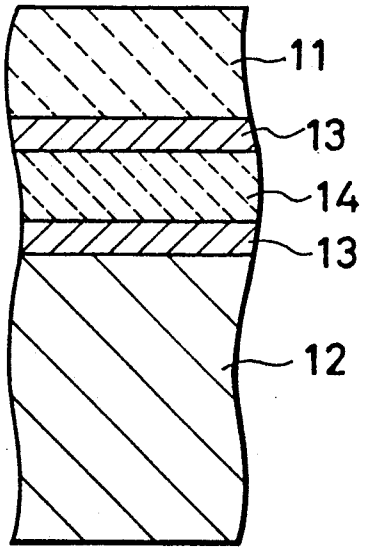
FIG. 3 is a schematically enlarged sectional view of a ceramic-coated leading edge portion of the bucket of the present invention.

In each of FIGS. 3, 4 and 5, reference numeral 11 denotes a ceramic coating layer; reference numeral 12, a heat resisting alloy base metal; reference numeral 13, an alloy layer comprising an alloy exhibiting resistance to high temperature oxidation and resistance to high temperature corrosion which are superior to the resistance of the base metal; and reference numeral 14, a mixture layer comprising the above-described alloy and ceramic material. The material comprising the ceramic coating layer 11 is a $ZrO_2$-type ceramic material which is composed of $ZrO_2$ as a main component and $Y_2O_3$, MgO, CaO and so on as additional components. The material comprising the alloy layer 13 is composed of at least one of Co and Ni, Cr and Al and at least one of Hf, Ta, Y, Si and Zr. The mixture layer 14 comprises a mixture containing $ZrO_2$-type ceramic material and the alloy material.

The composition of the ceramic material is at least one of $ZrO_2$ and 4 to 20 wt % of $Y_2O_3$, $ZrO_2$ and 4 to 8 wt % of CaO and $ZrO_2$ and 4 to 24 wt % of MgO. Spray coating powders of $ZrO_2$-based ceramic material having such a composition are produced by grinding and sizing $ZrO_2$-based ceramic material containing $Y_2O_3$, CaO or MgO which is formed by an electric melting method or a calcination method, each powder containing the above-described additive.

Each of materials used for forming alloy layers contains at least one of Ni and Co as a main component, 13 to 40 wt % of Cr, 5 to 20 wt % of Al and a total content of 0.1 to 3 wt % of at least one of Hf, Ta, Y, Si and Zr. Alloys having such a composition has excellent resistance to high temperature oxidation and resistance to high temperature corrosion.

In addition, heat resisting alloy base metal is super alloys having a composition comprising Ni as a main component, 7 to 20 wt % of Cr, 1 to 8 wt % of at least one of Ti and Al and Ta, Nb, W, Mo or Co, e.g., IN-738 (produced by Inconel Corp.) comprising Ni, 16% Cr, 8.5% Co, 3.4% Al, 3.4% Ti, 2.6% W, 1.7% Mo, 1.7% Ta, 0.9% Nb and 0.1% Zr, or a composition comprising Co as a main component, 25 to 35 wt % of Cr and Ni and W, e.g., FSX-414 (produced by GE Corp.) comprising Co, 30% Cr, 10% Ni, 2.0% Fe and 7.0% W.

In the embodiment of the present invention shown in FIG. 3, the two alloy layers 13 may comprise the same alloy or alloys composed of different components. The method of forming each of the layers is not particularly limited, but a plasma spray coating method is preferable from the viewpoint of the high material deposition velocities and the good workability. An electron beam vacuum evaporation method or a sputtering method may be used as a method of forming a coating layer such as an alloy layer or the like with a relatively small thickness.

Table 1 shows the results of repeated load tests conducted for the ceramic-coated test pieces of Example 1 (described hereinafter) of the present invention and conventional ceramic-coated test pieces which were formed for the purpose of comparison. In Table 1, Sample Nos. 1 and 8 concern the conventional ceramic-coated test pieces and Sample Nos. 9 to 23 concern the ceramic-coated test pieces of the present invention. Each of the repeated heat load tests was performed by repeatedly heating and cooling between 170° C. and 1000° C., and evaluation was conducted by examining the presence of damage in each of the ceramic-coated test pieces. The thickness of the ceramic coating layers in each of the ceramic-coated test pieces of the present invention is preferably 1.0 mm or less.

TABLE 1

Results of Repeated Heat Load Tests

| Sample No. | Thickness of (mm) Ceramic layer | Alloy layer I | Mixture layer | Alloy layer II | N* |
|---|---|---|---|---|---|
| 1 | 0.3 | — | — | 0.1 | 500 |

TABLE 1-continued

| Sample No. | Results of Repeated Heat Load Tests Thickness of (mm) Ceramic layer | Alloy layer I | Mixture layer | Alloy layer II | N* |
|---|---|---|---|---|---|
| 2 | 0.4 | — | — | 0.1 | 250 |
| 3 | 0.6 | — | — | 0.1 | 70 |
| 4 | 0.4 | — | — | 0.05 | 230 |
| 5 | 0.4 | — | 0.2 | 0.1 | 90 |
| 6 | 0.6 | — | 0.2 | 0.1 | 45 |
| 7 | 0.8 | — | 0.2 | 0.1 | 25 |
| 8 | 0.4 | — | 0.4 | 0.1 | 120 |
| 9 | 0.4 | 0.1 | 0.2 | 0.1 | 1250 |
| 10 | 0.6 | 0.1 | 0.2 | 0.1 | 900 |
| 11 | 0.8 | 0.1 | 0.2 | 0.1 | 750 |
| 12 | 1.0 | 0.1 | 0.2 | 0.1 | 600 |
| 13 | 1.2 | 0.1 | 0.2 | 0.1 | 95 |
| 14 | 0.4 | 0.02 | 0.2 | 0.1 | 250 |
| 15 | 0.4 | 0.03 | 0.2 | 0.1 | 900 |
| 16 | 0.4 | 0.3 | 0.2 | 0.1 | 1200 |
| 17 | 0.4 | 0.5 | 0.2 | 0.1 | 800 |
| 18 | 0.4 | 0.6 | 0.2 | 0.1 | 160 |
| 19 | 0.4 | 0.1 | 0.02 | 0.1 | 270 |
| 20 | 0.4 | 0.1 | 0.03 | 0.1 | 950 |
| 21 | 0.4 | 0.1 | 0.3 | 0.1 | 1100 |
| 22 | 0.4 | 0.1 | 0.5 | 0.1 | 850 |
| 23 | 0.4 | 0.1 | 0.6 | 0.1 | 200 |

N*: Number of times of repeated heat load until damage occurs in ceramic coating There is a tendency that the durability of a test piece to the repeated heat load test deteriorates if the thickness of the ceramic coating layer is more than 1 mm, as in Sample No. 13 shown in Table 1. The thickness of the alloy layer (the alloy layer I shown in Table 1) between the ceramic coating layer 11 and the mixture layer 14 is preferably within the range of 0.03 to 0.5 mm. There is also a tendency that the durability to the repeated heat load test deteriorates if the thickness of the alloy layer I is out of the above-described range, as in Sample Nos. 14 and 18 shown in Table 1. If the thickness of the alloy layer I is small, the alloy layer is unsatisfactory as a layer for preventing any oxidation or corrosion through the ceramic coating layer. On the other hand, if the thickness of the alloy layer I is large, the alloy layer itself functions as a layer which newly produces thermal stress and thus cancels the thermal stress reducing function of the mixture layer 14. The thickness of the mixture layer 14 is preferably within the range of 0.03 to 0.5 mm. When the thickness of the mixture layer is out of the above-described range, as in Example Nos. 19 and 23 shown in Table 1, the durability to the repeated heat load test deteriorates. When the thickness of the mixture layer is small, the mixture layer has an unsatisfactory function of reducing thermal stress. While when the thickness of the mixture layer is large, the mixture layer itself has a relatively low level of strength, as compared with the alloy layer and so on, and is thus broken owing to the thermal stress produced by the increase in the thickness of the mixture layer. The thickness of the alloy layer II shown in Table 1 is not particularly limited, but it is preferably within the range of 0.03 to 0.5 mm. The reason for this is the same as the alloy layer I shown in Table 1.

The mixing ratio between the ceramic material and the metal in the mixture layer is not particularly limited. The mixing ratio of the metal to the ceramic material in each of the mixture layers shown in Table 1 is 2/1. When the inventors have investigated mixture layers with other mixing ratios, the results obtained with the other mixing ratios were substantially the same as those shown in Table 1. Investigations have also been made on mixture layers in which a mixing ratio was gradually changed from a high ratio of metal to a high ratio of ceramic material. The effect was not so clear and was substantially the same as that obtained by the provision of a mixing layer with a uniform mixing ratio.

After each of the test pieces had been subjected to the high temperature oxidation test, it was subjected to a repeated heat load test which was the same as that described above. The temperature of the high temperature oxidation test was 1000° C., and the oxidation time was 500 hours. As a result, the ceramic coating layer of each of the ceramic-coated test pieces of Sample Nos. 5 to 8 shown in Table 1 was damaged and separated. On the other hand, as a result of repeated heat load tests of the other test pieces, each of the test pieces of Sample Nos. 1 to 4 exhibited a number of the times of heat load tests repeated until damage occurred which was reduced by 20 to 40% and thus exhibited deteriorated durability. While the ceramic-coated test pieces shown in Table 1 within the range of the present invention exhibited substantially the same results as those shown in Table 1. It was also observed that some of the test pieces within the range of the present invention exhibited increased numbers of the times of tests repeated until damage occurred.

Each of the test pieces was then subjected to a high temperature corrosion test using a molten salt coating method. The test was conducted by a method in which a molten salt comprising 25% NaCl and 75% $Na_2SO_4$ was coated on each of the test pieces which was then heated at 850° C. for 300 hours in the atmosphere. Each of the test pieces was then subjected to the repeated heat lead test which was the same as that described above. As a result, the ceramic coating of each of the test pieces of Sample Nos. 5 to 8 shown in Table 1 was damaged after the high temperature corrosion test. The results of the repeated heat load tests showed that each of the test pieces of Sample Nos. 1 to 4 exhibited a number of the times of tests repeated until damage occurred in the ceramic coating which was reduced by 20 to 40%, and thus exhibited slightly deteriorated durability. While the test pieces shown in Table 1 within the range of the present invention exhibited a number of the times of the tests repeated until damage occurred in the ceramic coatings which were the substantially the same as the results shown in Table 1 and particularly no deterioration in the durability thereof.

Although the method of producing the alloy layer 13 in any of the above-described ceramic-coated heat resisting alloy member of the present invention is not particularly limited, it is preferable to use plasma spray coating at a pressure which is reduced to a value below the atmospheric pressure in an atmosphere which comprises a shield gas or an inert gas. The method of producing the mixture layer 14 of a ceramic material and a metal is the same as that above described. In the case of the alloy layer 13 formed by plasma spray coating in an atmosphere at a reduced pressure, the alloy powder used is not easily oxidized during spray coating, and thus the alloy layer 13 formed is a coating layer having a dense structure in which no contaminants such as oxide coating is mixed. In the mixture layer 14, the alloy powder comprising the mixture layer is not easily oxidized, and thus the metal portion in the mixture layer 14 is a coating layer having no contaminants such as the oxide coating mixed therein.

As described above, in each of conventional known ceramic-coated members, the mixture layer itself which comprises a mixture of a metal and a ceramic material is damaged and thus cannot exhibit its primary function of reducing the thermal stress produced between the ceramic coating layer 11 and the base metal 12 under the conditions of high temperature oxidation or high temperature corrosion. The mixture layer rather produces new thermal stress and thus exhibits durability which is inferior to that of a ceramic coating provided with no mixture layer, for example, in a repeated heat load test. While, in the ceramic coating of the present invention, the mixture layer 14 exhibits its function of reducing thermal stress even at high temperature or under high temperature corrosive conditions and is thus effective to improve the durability of the ceramic coating. In addition, when the thickness of the ceramic coating layer 11 is increased, the ceramic-coated heat resisting alloy member formed exhibits no deterioration in its durability, as well as exhibiting a high level of heat barrier effect and high performance.

Figure 6:
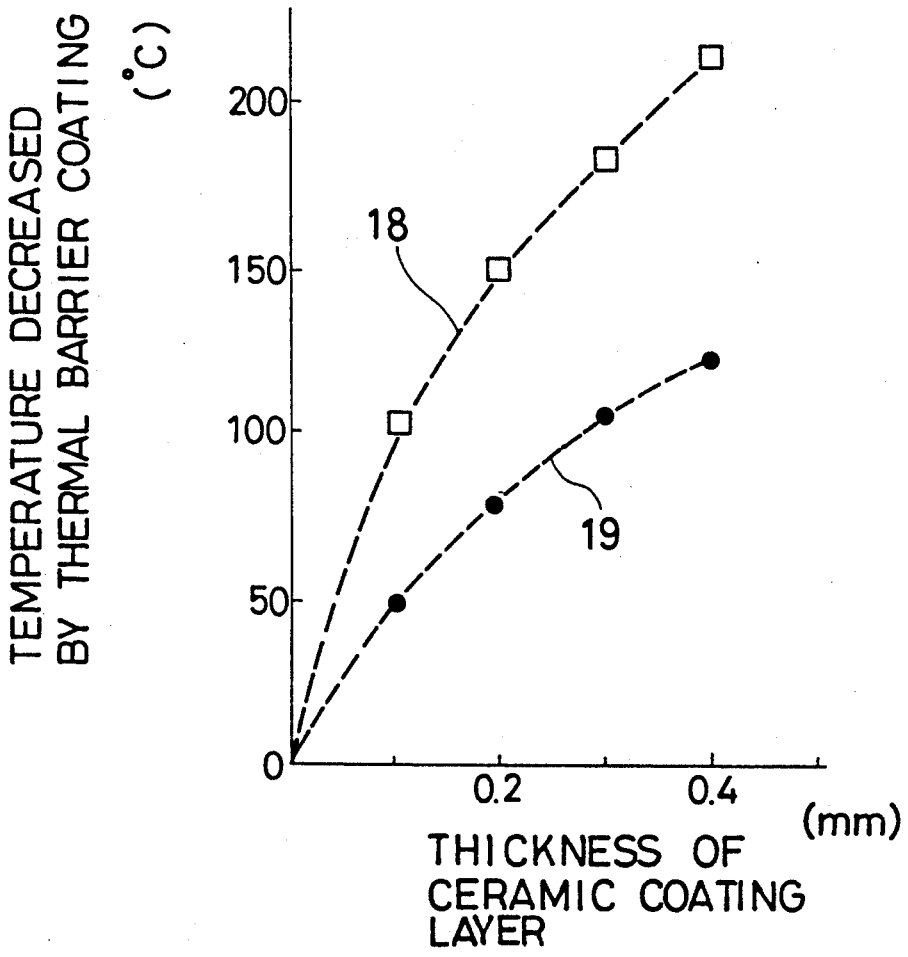
FIG. 6 is a graph illustrating the thermal barrier characteristics of the coating layer.

FIG. 6 illustrates the relationship between the thickness of a ceramic layer and temperature decreased by thermal barrier coating obtained on the basis of the thermal conditions at the leading edge of the bucket of a gas turbine. Referring to FIG. 6, reference numeral 18 represents results of a ceramic coating applied to the leading edge of a bucket according to the present invention, while 19 represents results of a conventional ceramic coating 19. The thickness of the mixture layer of ceramic material and metal of the ceramic coating applied to the leading edge of a bucket according to the present invention is 0.3 mm. The decreased temperature becomes about two times the conventional ceramic coating due to the thermal resistance of the portion applied with the ceramic coating even if the thickness is the same. As described above, the ceramic coating applied to the leading edge of the bucket according to the present invention exhibits excellent heat insulating characteristics.

EXAMPLE 1

Figure 1:
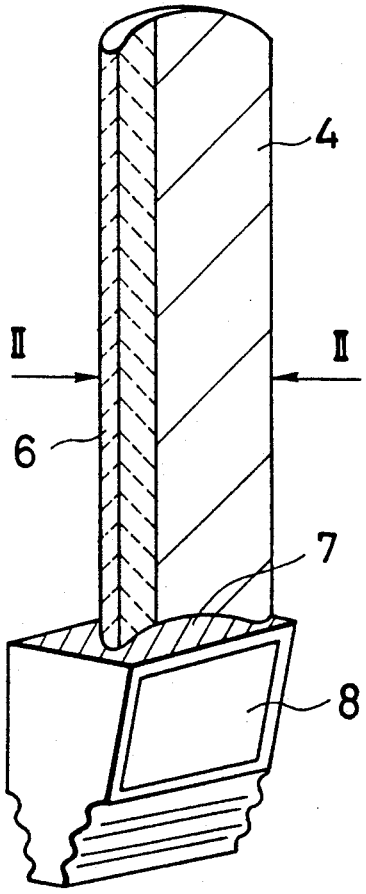
FIG. 1 is a perspective view of a gas turbine bucket of the present invention.
Figure 2:
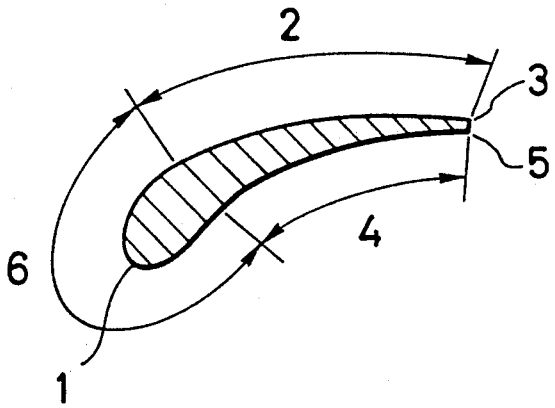
FIG. 2 is a schematically cross sectional view taken along line II—II of the bucket of FIG. 1.
Figure 9:
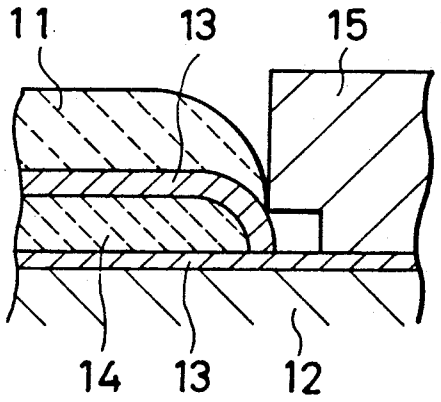
FIGS. 7 through 9 are schematically enlarged sectional views illustrating the detail of coating layers in process of deposition of the present invention.
Figure 8:
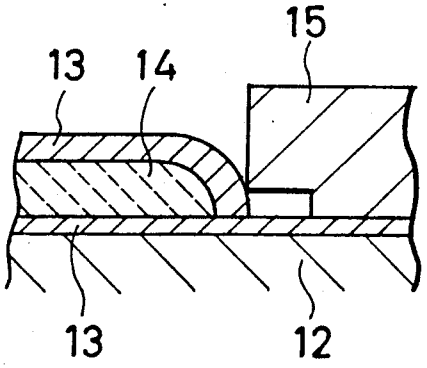
Figure 7:
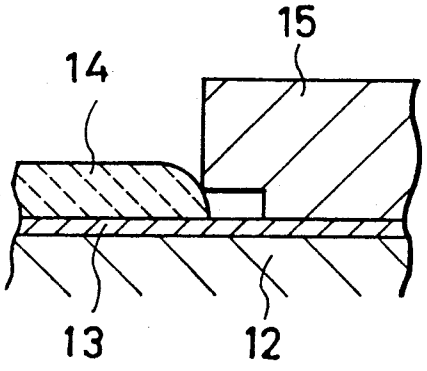

An Ni-based alloy IN-738 was used as a base material of a bucket for a gas turbine shown in FIG. 1, and a surface thereof was then degreased and then subjected to blasting using an alumina grit. An alloy layer was then formed on the base material of a portion 6 and 7 by plasma spray coating using an alloy material comprising 32% by weight of Ni, 21% by weight of Cr, 8% by weight of Al, 0.5% by weight of Y and the balance composed of Co. The plasma spray coating was performed at pressure of 200 Torr in an atmosphere of argon. The power of plasma was 40 kW. The alloy layer formed under these conditions had a thickness of 0.1 mm. A mixture comprising a ceramic powder containing $ZrO_2$ and 8% by weight of $Y_2O_3$ and alloy powder having the above-described composition was then spray-coated on the alloy layer formed only in the vicinity of the leading edge of the blade using a masking material. The mixing ratio between the metal and ceramic power was as shown in Table 2. The conditions of spray coating were the same as those employed in the formation of the alloy layer 13. In this way, a mixture layer 14 comprising the mixture of ceramic material and a metal was formed on the alloy layer 13. The thickness of the mixture layer 14 was 0.3 mm. The conditions of spray coating were the same as those employed in the formation of the alloy layer 13. FIG. 7 illustrates the masking material 15 and the mixture layer 14. The position of the masking material was changed and then the alloy powder having the above-described composition was spray-coated on the mixture layer 14 under the same conditions as those employed in the formation of the alloy layer 13 to form an alloy layer 13 having a thickness of 0.1 mm. FIG. 8 illustrates the masking material 15 and the alloy layer 13. After changing the masking portion, a powder comprising $ZrO_2$ and 8% by weight of $Y_2O_3$ was further spray-coated on the alloy layer 13 formed. The spray coating was performed with a plasma power of 50 kW in the atmosphere. The thickness of the coating layer comprising $ZrO_2$ and 8% by weight of $Y_2O_3$ was 0.4 mm. FIG. 9 illustrates the masking material 15 and the ceramic layer 11. Heating treatment was then effected at 1120° C. for 2 hours under vacuum so that the base material and the alloy layer in contact with the base material were subjected to diffusion treatment.

TABLE 2

Number of Times of Heat Load Tests Repeated Until Damage Occurs in Ceramic Coating

| Test method | Mixing ratio[4] (M/C) 4/1 | 2/1 | 1/1 | 1/2 | 1/4 |
|---|---|---|---|---|---|
| Repeated heat load test[1] | 1170 | 1250 | 1200 | 1270 | 1150 |
| Repeated heat load test after high temperature oxidation test[2] | 1250 | 1170 | 1250 | 1350 | 1100 |
| Repeated heat load test after high temperature corrosion test[3] | 1100 | 1150 | 1150 | 1170 | 1050 |

[1] Repeated heat load test: 1000° C. 170° C.
[2] High temperature oxidation test: 1000° C., 500 hours (heating in the atmosphere)
[3] High temperature corrosion test: 850° C., 300 hours (25% NaCl + 75% $Na_2So_4$)
[4] M/C: a ratio by volume of the metal to ceramics Each of the thus-formed ceramic-coated test pieces was then subjected to the repeated heat load test which was the same as that described above. Table 2 shows the number of the times of heat load tests repeated until the ceramic coating of each of the test pieces was damaged. In the high temperature oxidation tests at 1000° C. for 500 hours, no damage was observed in any ceramic coating after the oxidation tests. When the repeated heat load tests of the test pieces were conducted in the same way as that described above, the numbers obtained of the times of tests repeated until the ceramic coatings were damaged are shown in Table 2. When a molted salt comprising 25% NaCl and 75% $Na_2So_4$ was then spray-coated on each of the test pieces which were then subjected to high temperature corrosion tests performed by heating in the atmosphere at 850° C. for 300 hours, no damage was observed in any ceramic coating.

EXAMPLE 2

Pretreatment of a Ni-based alloy IN738 which was used as a base metal of a gas turbine bucket was effected by the same method as that employed in Example 1. An alloy layer and a mixture layer were then formed on the base metal using the materials and the method which were the same as those employed in Example 1. The mixing ratio between the ceramic material and the metal in the mixture layer was 1:1. The thickness of the mixing layer was also the same as that in Example 1. An alloy layer having a thickness of 0.02 mm was then formed on the mixture layer by sputtering using as a target an alloy material comprising 32% by weight of Ni, 21% by weight of Cr, 8% by weight of Al, 0.5% by weight of Y and the balance composed of Co. The sputtering was performed under such conditions that the applied voltage was 2 kV and the treatment time was 2 hours. A ceramic coating layer was then formed in the same method as that employed in Example 1. Heat treatment was then effected at 1120° C. for 2 hours so that diffusion treatment was effected. When the thus-formed ceramic-coated test piece was subjected to the durability test in the same manner as that in Example 1, the results obtained were substantially the same as those in Example 1.

EXAMPLE 3

Figure 10:
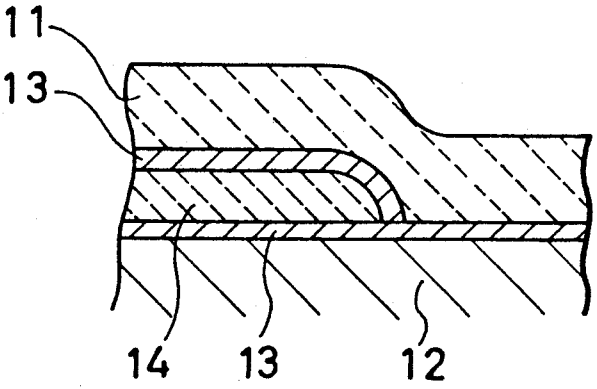
FIG. 10 is a schematically enlarged sectional view illustrating the detail of coating layers of other embodiment of the present invention.

A bucket for the gas turbine similar to that according to Embodiment 1 was used and the pre-treatment was performed by a method similar to that for Example 1. Then, the same materials as those used in Example 1 were used so that the alloy layer, the mixture layer and another alloy layer were formed in the above-described order. The mixture ratio of ceramic material and metal in the mixture layer was 1:1 and the respective thicknesses of the above-described two components were the same. Then, the ceramic layer similar to that according to Example 1 was formed on the alloy layer without using any masking material. In this case, the ceramic layer was formed on the entire surface of the bucket. As a result, the boundary between the ceramic coating layer applied to the leading edge of the bucket having the high durability and heat resistance characteristics and the trailing portion of the thin ceramic coating applied on the suction surface and the pressure surface of the bucket became as shown in FIG. 10. The bucket applied with the thus formed ceramic coating according to the present invention exhibits in its leading edge, which is subjected to severe environment in which the thermal load is large, has excellent durability and heat insulating characteristics.

EXAMPLE 4

Figure 15:
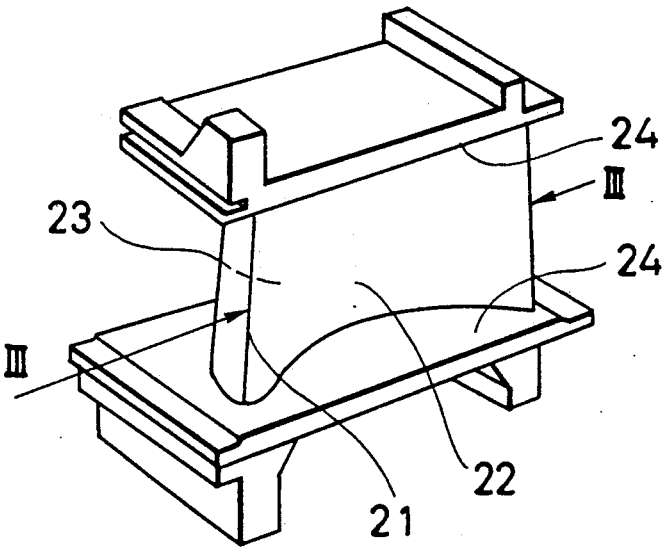
FIG. 15 is a perspective view of a gas turbine nozzle of the present invention.
Figure 16:
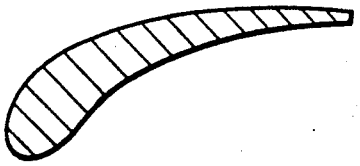
FIG. 16 is a schematically cross sectional view taken along line III—III of the nozzle of FIG. 15.

FIG. 15 illustrates a nozzle of a gas turbine made of Co-base alloy FSX-414. FIG. 16 is a cross sectional view taken along a line corresponding to the average diameter of the nozzle, that is, line III—III. FIG. 15 illustrates the leading edge 21, a pressure surface 22, a suction surface 23 and a platform 24 of the nozzle.

Figure 17:
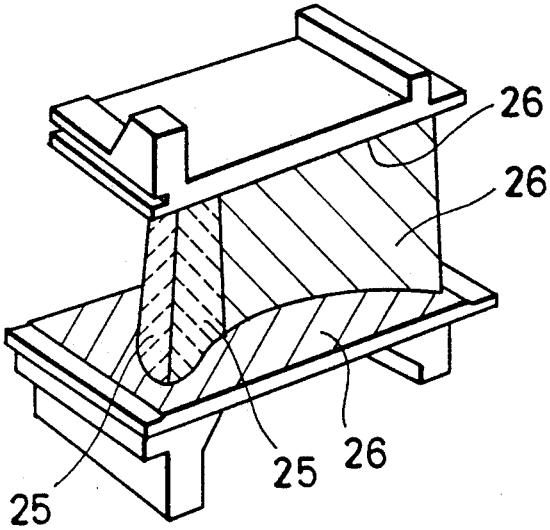
FIG. 17 is a perspective view of a gas turbine nozzle in accordance with Example 4 of the present invention.
Figure 18:
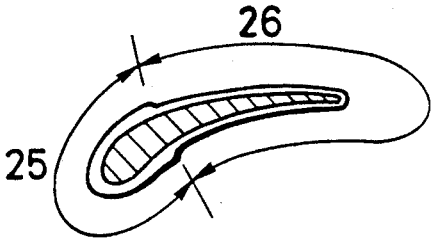
FIG. 18 is a schematically cross sectional view of the nozzle of FIG. 17.

According to this embodiment, a material similar to that used according to Example 1 was used and the ceramic coating layer having the similar thickness was formed by a method also similar to Example 1. FIG. 17 illustrates the appearance of the nozzle applied with the coating, FIG. 18 illustrates the cross sectional shape of the same. Referring to the drawings, the portion in the vicinity of the leading edge of the nozzle is a ceramic coating portion 25 and the other portions and the platform surface are an alloy coating portion 26. The ceramic coating portion is formed in the vicinity of the leading edge of the nozzle in a region extending from the leading edge of the nozzle to the suction surface and the pressure surface in a quarter length of the overall length of the cross sectional profile of the nozzle. The thus formed nozzle for a gas turbine according to the present invention was, similarly to Example 1, subjected to the repeated heat load test, and the high temperature oxidation test and the high temperature corrosion test before again applying the repeated heat load test. As a result, substantially the similar effects to those obtained in Example 1 were obtained.

EXAMPLE 5

A nozzle for a gas turbine similar to that of Example 4 was used, the coating material similar to that according to Example 3 was used and the similar thickness coating layer was formed by the similar method.

Figure 19:
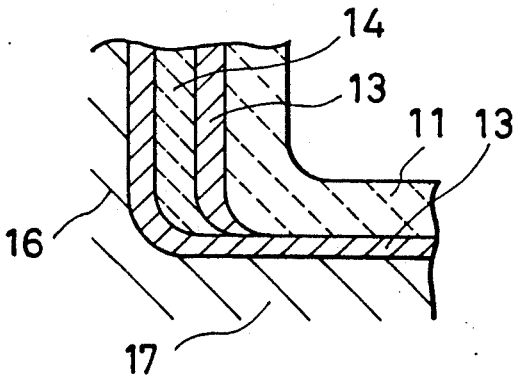
FIG. 19 is a detailed illustration of a transition from a blade to a platform of the nozzle of FIG. 17.

The nozzle according to this embodiment is applied with a coating layer arranged in such a manner that the portion designated by reference numeral 25 shown in FIGS. 17 and 18 is formed by a ceramic layer/an alloy layer/a mixture layer composed by ceramic material and an alloy metal/an alloy layer. The portion 25 is the portion in the vicinity of the leading edge which is subjected to a severe thermal load and is applied with the coating for its region extending from the leading edge of the nozzle to the suction surface and the pressure surface in a quarter length of the overall length of the cross sectional profile of the nozzle. The portion 26 shown in FIGS. 17 and 18, that is, the surface of the nozzle, except for the portion in the vicinity of the leading edge of the nozzle, and the platform are portions applied with the ceramic layer/the alloy layer coating. The boundary between the coating applied to the leading edge and both of the suction surface and the pressure surface is formed similarly to that shown in FIG. 10. Furthermore, the boundary between the surface of the nozzle in the portion in the vicinity of the leading edge and the platform is illustrated in FIG. 19 in detail. Also in the above-described boundaries, a mixture layer 14 of ceramic material and the alloy metal which can be easily damaged by high temperature oxidation and high temperature corrosion is sufficiently covered with the alloy layer. The thus formed nozzle for a gas turbine according to the present invention was, similarly to Example 1, subjected to the repeated heat load test, and the high temperature oxidation test and the high temperature corrosion test before again applying the repeated heat load test. As a result, substantially the similar effects to those obtained in Example 1 were obtained.

Figure 20:
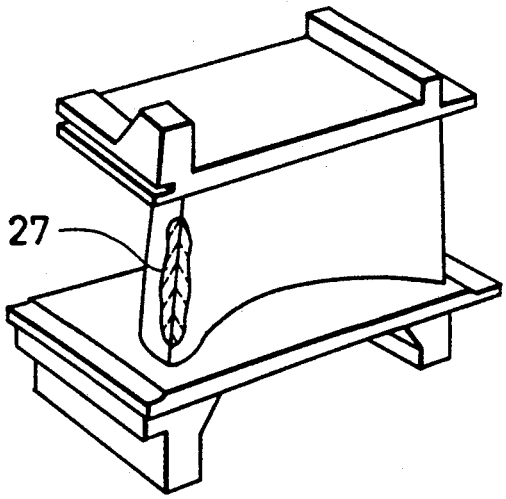
FIG. 20 is a perspective view illustrating a region of separation occurred in the ceramic coating of the nozzle of FIG 17.

Furthermore, the nozzle for a gas turbine manufactured according to this embodiment was subjected to a combustion test under conditions that the temperature of the combustion gas was 1250° C. and the pressure of the combustion gas was 8.8 ata simulated to an actual gas turbine. The temperature of air for cooling the inside portion of the nozzle was 170° C. The test was applied to six arranged nozzles for a gas turbine. Four of the six nozzles are the nozzles for a gas turbine applied with the ceramic coating according to this embodiment, while two nozzles are the nozzles for a gas turbine applied with a ceramic coating formed by a ceramic layer/an alloy layer. The latter two comparative nozzles were respectively applied with the coating the material of which is similar to that according to Example 1 by a similar method. However, the process in which the mixture layer of ceramic material and the alloy metal was omitted. The thickness of each of the two ceramic layers of each of this two nozzles was 0.4 mm and that of the alloy layer was 0.1 mm. After a cycle constituted by start—holding the regular operation state—stop had been repeated 10 times, the nozzle for a gas turbine according to this embodiment was normal without any separation observed in any portions. However, as shown in FIG. 20, a separation of the ceramic layer took place in the hatched portion 27 close to the leading edge to which the severe thermal load is applied in the comparative nozzles for a gas turbine applied with the coating composed by only the ceramic layer/the alloy layer. As described above, an evidence was given in the actual test that the nozzle for a gas turbine applied with the ceramic coating according to the present invention has excellent durability.

As described above, the ceramic coating according to the present invention is constituted in such a manner that the alloy layer exhibiting excellent resistance to high temperature oxidation and resistance to high temperature corrosion is formed between the ceramic layer and the mixture layer of ceramic material and metal. As a result, the mixture layer can exhibit the satisfactory thermal stress relaxing effect. Consequently the thickness of the ceramic layer can be reduced without a fear of reduction in the durability. Furthermore, the heat insulating characteristics of the ceramic layer depending upon its thickness can be improved. In addition, the thermal resistance of the mixture layer can contribute to the heat insulating characteristics. Therefore, a coating exhibiting excellent heat insulating characteristics and durability can be obtained. When the ceramic coating thus having the above-described excellent characteristics is employed as the coating for the portions in the vicinity of the leading edges of the bucket and the nozzle of the gas turbine which are subjected to a severe environments in which a large thermal load can be applied, the temperature of the leading edge of each of the bucket and the nozzle can be lowered due to the heat insulating characteristics of the ceramic coating, causing the reliability of the bucket and the nozzle to be improved. Furthermore, the necessary quantity for cooling the bucket or the nozzle can be reduced, causing the efficiency of the gas turbine to be improved. Furthermore, the manufacturing of the bucket and the nozzle can be facilitated and the performance of a gas turbine can be stably exhibited for a long time by reducing the thickness of the coating to be applied to the suction surface and the pressure surface of the blade which influences the area of the passage through which the combustion gas flows. That is, in order to design the gap between the neighboring blades to the dimension required on the view point of the turbine design necessity, the thickness of the blade must be arranged precisely. According to the above-described arrangement in which the thickness of the coating applied to the trailing surfaces of the blade is reduced, the dimension determination for the suction surface and the pressure surface of the blade can be easily performed. Even if the coating applied to the above-described portions is damaged, the deterioration in the efficiency of the gas turbine can be prevented since the thickness of the coating is a small value. As described above, the bucket and the nozzle for a gas turbine according to the present invention is able to exhibit an effect of improving the reliability of the blade and the efficiency of the gas turbine.

What is claimed is:

1. A gas turbine bucket applied with a ceramic coating comprising:

a base material of said bucket made of a heat resisting alloy the main component of which is selected from at least one of nickel, cobalt and iron; and a plurality of coating layers for the front portion of said bucket which is applied to a region extending from the leading edge of said bucket to the suction surface and the pressure surface of said bucket in substantially a quarter length of the overall length of the profile of said bucket;

said plurality of coating layers for the front portion consisting of:

a mixture layer which comprises a ceramic material and a metal and which is formed on said base metal;

an alloy layer which comprises an alloy material superior to said base material of said bucket with respect to its resistance to high temperature oxidation and resistance to high temperature corrosion and which is formed on said mixture layer; and a ceramic layer which comprises a ceramic material and which is formed on said alloy layer, said ceramic material of said ceramic layer comprising $ZrO_2$ as a main component and at least one of CaO, $Y_2O_3$ and MgO;

wherein said mixture layer prevents said ceramic layer from any damage owing to a thermal stress associated with the difference in the coefficients of thermal expansion between said ceramic material and said base material, and wherein said alloy layer prevents said mixture layer from oxidation and corrosion occurring therein through said ceramic layer.

2. A gas turbine bucket according to claim 1, wherein said alloy layer comprises at least one of cobalt and nickel as a main component, chromium and aluminum and at least one of hafnium, tantalum, yttrium, silicon and zirconium.

3. A gas turbine bucket according to claim 1, wherein said mixture layer comprises a mixture material containing a ceramic material which is composed of $ZrO_2$ as a main component and at least one of CaO, $Y_2O_3$ and MgO, and an alloy material composed of at least one of cobalt and nickel, chromium and aluminum and at least one of hafnium, tantalum, yttrium, silicon and zirconium.

4. A gas turbine bucket according to claim 3, wherein the thickness of said ceramic layer is 0.05 to 1.0 mm, the thickness of said alloy layer is 0.03 to 0.5 mm and the thickness of said mixture layer is 0.03 to 0.5 mm.

5. A gas turbine bucket according to claim 4, wherein said alloy layer comprises at least one of cobalt and nickel as a main component, chromium and aluminum and at least one of hafnium, tantalum, yttrium, silicon and zirconium.

6. A gas turbine bucket applied with a ceramic coating comprising:

a base material of said bucket made of a heat resisting alloy the main component of which is selected from at least one of nickel, cobalt and iron; and a plurality of coating layers for the front portion of said bucket which is applied to a region extending from the leading edge of said bucket to the suction surface and the pressure surface of said bucket in substantially a quarter length of the overall length of the profile of said bucket;

said plurality of coating layers for the front portion consisting of:

a first alloy layer which comprises an alloy material superior to said base material with respect to its resistance to high temperature oxidation and resistance to high temperature corrosion and which is formed on said base material;

a mixture layer which comprises a ceramic material and a metal and which is formed on said first alloy layer;

a second alloy layer which comprises an alloy material superior to said base material with respect to its resistance to high temperature oxidation and resistance to high temperature corrosion and which is formed on said mixture layer; and a ceramic layer which comprises a ceramic material and which is formed on said second alloy layer, said ceramic material of said ceramic layer comprising $ZrO_2$ as a main component and at least one of CaO, $Y_2O_3$ and MgO.

7. A gas turbine bucket according to claim 6, wherein said alloy layers comprise at least one of cobalt and nickel as a main component, chromium and aluminum and at least one of hafnium, tantalum, yttrium, silicon and zirconium.

8. A gas turbine bucket according to claim 6, wherein said mixture layer comprises a mixture material containing a ceramic material which is composed of $ZrO_2$ as a main component and at least one of CaO, $Y_2O_3$ and MgO, and an alloy material composed of at least one of cobalt and nickel, chromium and aluminum and at least one of hafnium, tantalum, yttrium, silicon and zirconium.

9. A gas turbine bucket according to claim 8, wherein the thickness of said ceramic layer is 0.05 to 1.0 mm, the thickness of each of said alloy layers is 0.03 to 0.5 mm and the thickness of said mixture layer is 0.03 to 0.5 mm.

10. A gas turbine bucket according to claim 9, wherein said alloy layer comprises at least one of cobalt and nickel as a main component, chromium and aluminum and at least one of hafnium, tantalum, yttrium, silicon and zirconium.

11. A gas turbine bucket applied with a ceramic coating comprising:

a base material of said bucket made of a heat resisting alloy the main component of which is selected from at least one of nickel, cobalt and iron;

a plurality of coating layers for the front portion of said bucket which is applied to a region extending from the leading edge of said bucket to the suction surface and the pressure surface of said bucket in substantially a quarter length of the overall length of the profile of said bucket; and a coating layer for the rear portion which is applied to the surface of said bucket except for said region, said plurality of coating layers for said front portion consisting of:

a mixture layer which comprises a ceramic material and metal and which is formed on said base material of said bucket;

a first alloy layer which comprises an alloy material superior to said base material with respect to its resistance to high temperature oxidation and resistance to high temperature corrosion and which is formed on said mixture layer;

a ceramic layer which comprises a ceramic material and which is formed on said first alloy layer, said ceramic material of said ceramic layer comprising $ZrO_2$ as a main component and at least one of CaO, $Y_2O_3$ and MgO; and said coating layer for the rear portion consisting of:

a second alloy layer which comprises an alloy material superior to said base material with respect to its resistance to high temperature oxidation and resistance to high temperature corrosion and which is formed on said base material of said bucket;

wherein the thickness of said coating layer for said rear portion is smaller than that for said front portion and successively formed.

12. A gas turbine bucket according to claim 11, wherein an end portion of said mixture layer of said coating layers for said front portion is sealed by said second alloy layer of said coating layer for said rear portion.

13. A gas turbine bucket according to claim 11, wherein said alloy layers comprise at least one of cobalt and nickel as a main component, chromium and aluminum and at least one of hafnium, tantalum, yttrium, silicon and zirconium.

14. A gas turbine bucket according to claim 11, wherein said mixture layer comprises a mixture material containing a ceramic material which is composed of $ZrO_2$ as a main component and at least one of CaO, $Y_2O_3$ and MgO, and an alloy material composed of at least one of cobalt and nickel, chromium and aluminum and at least one of hafnium, tantalum, yttrium, silicon and zirconium.

15. A gas turbine bucket according to claim 14, wherein the thickness of said ceramic layer is 0.05 to 1.0 mm, the thickness of each of said alloy layers is 0.03 to 0.5 mm and the thickness of said mixture layer is 0.03 to 0.5 mm.

16. A gas turbine bucket according to claim 15, wherein said alloy layer comprises at least one of cobalt and nickel as a main component, chromium and aluminum and at least one of hafnium, tantalum, yttrium, silicon and zirconium.

17. A gas turbine bucket applied with a ceramic coating comprising:

a base material of said bucket made of a heat resisting alloy the main component of which is selected from at least one of nickel, cobalt and iron;

a plurality of coating layers for the front portion of said bucket which is applied to a region extending from the leading edge of said bucket to the suction surface and the pressure surface of said bucket in substantially a quarter length of the overall length of the profile of said bucket; and a plurality of coating layers for the rear portion which is applied to the surface of said bucket except for said region, said plurality of coating layers for said front portion consisting of:

a first alloy layer which comprises an alloy material superior to said base material with respect to its resistance to high temperature oxidation and resistance to high temperature corrosion and which is formed on the surface of said base material of said bucket;

a mixture layer which comprises a ceramic material and metal and which is formed on said first alloy layer;

a second alloy layer which comprises an alloy material superior to said base material with respect to its resistance to high temperature oxidation and resistance to high temperature corrosion and which is formed on said mixture layer; and a first ceramic layer which comprises a ceramic material and which is formed on said second alloy layer; and said plurality of coating layers for said rear portion consisting of:

a third alloy layer which comprises an alloy material superior to said base material with respect to its resistance to high temperature oxidation and resistance to high temperature corrosion and which is formed on the surface of said base material of said bucket; and a second ceramic layer which comprises a ceramic material and which is formed on said third alloy layer, said ceramic material of said first and second ceramic layers comprising $ZrO_2$ as a main component and at least one of CaO, $Y_2O_3$ and MgO;

wherein the thickness of said coating layer for said rear portion is smaller than that for said front portion and is successively formed.

18. A gas turbine bucket according to claim 17, wherein an end portion of said mixture layer of said coating layer for said front portion is sealed by said third alloy layer of said coating layer for said rear portion.

19. A gas turbine bucket according to claim 17, wherein said alloy layers comprise at least one of cobalt and nickel as a main component, chromium and aluminum and at least one of hafnium, tantalum, yttrium, silicon and zirconium.

20. A gas turbine bucket according to claim 17, wherein said mixture layer comprises a mixture material containing a ceramic material which is composed of $ZrO_2$ as a main component and at least one of CaO, $Y_2O_3$ and MgO, and an alloy material composed of at least one of cobalt and nickel, chromium and aluminum and at least one of hafnium, tantalum, yttrium, silicon and zirconium.

21. A gas turbine bucket according to claim 20, wherein the thickness of each of said ceramic layers is 0.05 to 1.0 mm, the thickness of each of said alloy layers is 0.03 to 0.5 mm and the thickness of said mixture layer is 0.03 to 0.5 mm.

22. A gas turbine bucket according to claim 21, wherein said alloy layer comprises a least one of cobalt and nickel as a main component, chromium and aluminum and at least one of hafnium, tantalum, yttrium, silicon and zirconium.

23. A gas turbine nozzle applied with a ceramic coating comprising:

a base material of said nozzle made of a heat resisting alloy the main component of which is selected from at least one of nickel, cobalt and iron;

a plurality of coating layers for the front portion of said nozzle which is applied to a region extending from the leading edge of said nozzle to the suction surface and the pressure surface of said nozzle in substantially a quarter length of the overall length of the profile of said nozzle; and a coating layer for the rear portion which is applied to the surface of said nozzle except for said region, said plurality of coating layers for said front portion consisting of:

a mixture layer which comprises a ceramic material and metal and which is formed on said base material of said nozzle;

a first alloy layer which comprises an alloy material superior to said base material with respect to its resistance to high temperature oxidation and resistance to high temperature corrosion and which is formed on said mixture layer;

a ceramic layer which comprises a ceramic material and which is formed on said third alloy layer, said ceramic material of said ceramic layer comprising $ZrO_2$ as a main component and at least one of CaO, $Y_2O_3$ and MgO; and said coating layer for said rear portion consisting of:

a second alloy layer which comprises an alloy material superior to said base material with respect to its resistance to high temperature oxidation and resistance to high temperature corrosion and which is formed on said base material of said nozzle;

wherein the thickness of said coating layer for said rear portion is smaller than that for said front portion and successively formed.

24. A gas turbine nozzle according to claim 23, wherein an end portion of said mixture layer of said coating layers for said front portion is sealed by said second alloy layer of said coating layer for said rear portion.

25. A gas turbine nozzle according to claim 23, wherein said alloy layers comprise at least one of cobalt and nickel as a main component, chromium and aluminum and at least one of hafnium, tantalum, yttrium, silicon and zirconium.

26. A gas turbine nozzle according to claim 23, wherein said mixture layer comprises a mixture material containing a ceramic material which is composed of $ZrO_2$ as a main component and at least one of CaO, $Y_2O_3$ and MgO, and an alloy material composed of at least one of cobalt and nickel, chromium and aluminum and at least one of hafnium, tantalum, yttrium, silicon and zirconium.

27. A gas turbine nozzle according to claim 26, wherein the thickness of said ceramic layer is 0.05 to 1.0 mm, the thickness of each of said alloy layers is 0.03 to 0.5 mm and the thickness of said mixture layer is 0.03 to 0.5 mm.

28. A gas turbine nozzle according to claim 27, wherein said alloy layer comprises a least one of cobalt and nickel as a main component, chromium and aluminum and at least one of hafnium, tantalum, yttrium, silicon and zirconium.

29. A gas turbine nozzle applied with a ceramic coating comprising:

a base material of said nozzle made of a heat resisting alloy the main component of which is selected from at least one of nickel, cobalt and iron;

a plurality of coating layers for the front portion of said nozzle which is applied to a region extending from the leading edge of said nozzle to the suction surface and the pressure surface of said nozzle in substantially a quarter length of the overall length of the profile of said nozzle; and a plurality of coating layers for the rear portion which is applied to the surface of said nozzle except for said region, said plurality of coating layers for said front portion consisting of:

a first alloy layer which comprises an alloy material superior to said base material with respect to its resistance to high temperature oxidation and resistance to high temperature corrosion and which is formed on the surface of said base material of said nozzle;

a mixture layer which comprises a ceramic material and metal and which is formed on said first alloy layer;

a second alloy layer which comprises an alloy material superior to said base material with respect to its resistance to high temperature oxidation and resistance to high temperature corrosion and which is formed on said mixture layer;

a first ceramic layer which comprises a ceramic material and which is formed on said second alloy layer, said ceramic material of said first ceramic layer comprising $ZrO_2$ as a main component and at least one of CaO, $Y_2O_3$ and MgO; and said plurality of coating layers for said rear portion consisting of:

a third alloy layer which comprises an alloy material superior to said base material with respect to its resistance to high temperature oxidation and resistance to high temperature corrosion and which is formed on the surface of said base material of said nozzle; and a second ceramic layer which comprises a ceramic material and which is formed on said third alloy layer wherein the thickness of said coating layer for said rear portion is smaller than that for said front portion and successively formed.

30. A gas turbine nozzle according to claim 29, wherein an end portion of said mixture layer of said coating layer for said front portion is sealed by said third alloy layer of said coating layer for said rear portion.

31. A gas turbine nozzle according to claim 29, wherein said alloy layers comprise at least one of cobalt and nickel as a main component, chromium and aluminum and at least one of hafnium, tantalum, yttrium, silicon and zirconium.

32. A gas turbine nozzle according to claim 29, wherein said mixture layer comprises a mixture material containing a ceramic material which is composed of $ZrO_2$ as a main component and at least one of CaO, $Y_2O_3$ and MgO, and an alloy material composed of at least one of cobalt and nickel, chromium and aluminum and at least one of hafnium, tantalum, yttrium, silicon and zirconium.

33. A gas turbine nozzle according to claim 32, wherein the thickness of each of said ceramic layers is 0.05 to 1.0 mm, the thickness of each of said alloy layers is 0.03 to 0.5 mm and the thickness of said mixture layer is 0.03 to 0.5 mm.

34. A gas turbine nozzle according to claim 33, wherein said alloy layer comprises a least one of cobalt and nickel as a main component, chromium and aluminum and at least one of hafnium, tantalum, yttrium, silicon and zirconium.

35. A gas turbine bucket applied with a ceramic coating comprising:

a base material of said bucket made of a heat resisting alloy;

a plurality of coating layers for the front portion of said bucket which is applied to a region extending from the leading edge of said bucket to the suction surface and the pressure surface of said bucket in substantially a quarter length of the overall length of the profile of said bucket; and a plurality of coating layers for the rear portion which is applied to the surface of said bucket except for said region, said plurality of coating layers for said front portion consisting of:

a first alloy layer which comprises an alloy material and which is formed on the surface of said base material by a spray coating method;

a mixture layer which comprises a ceramic material and metal in a ratio by weight of 1:1 and which is formed on said first alloy layer by a spray coating method;

a second alloy layer which comprises an alloy material and which is formed on said mixture layer by a spray coating method; and a first ceramic layer which comprises a ceramic material and which is formed on said second alloy layer by a spray coating method; and said plurality of coating layers for said rear portion consisting of:

a third alloy layer which comprises an alloy material and which is formed on the surface of said base material by a spray coating method; and a second ceramic layer which comprises a ceramic material and which is formed on said third alloy layer by a spray coating method, wherein the thickness of said coating alyers for said rear portion is smaller than that for said front portion and successively formed, and wherein said heat resisting alloy of base material comprises at least one of Ni and Co as a main component, 7 to 20 wt % of Cr and 1 to 8 wt % of at least one of Ti and Al, and at least one of Ta, Nb, W and Mo in a total content of 10 wt % or less;

said alloy material of said first, second and third alloy layers comprises at least one of Ni and Co, 13 to 40 wt % of Cr, 5 to 20 wt % of Al, and 0.1 to 3 wt % of at least one of Hf, Ta, Y, Si and Zr;

said ceramic material of said first and second ceramic layers comprises $ZrO_2$ as a main component, and at least one of 4 to 20 wt % of $Y_2O_3$, 4 to 8 wt % of CaO and 4 to 24 wt % of MgO;

the thickness of each of said alloy layers is 0.1 mm;

the thickness of said mixture layer is 0.3 mm;

the thickness of each of said ceramic layers is 0.4 mm; and said spray coating method is a plasma spray coating method.

* * * * *